US008677651B2

(12) United States Patent
Cross

(10) Patent No.: US 8,677,651 B2
(45) Date of Patent: Mar. 25, 2014

(54) ADHESIVE FOOTWEAR

(76) Inventor: Adam Paul Cross, Lafayette, LA (US)

( * ) Notice: Subject to any disclaimer, the term of this patent is extended or adjusted under 35 U.S.C. 154(b) by 34 days.

(21) Appl. No.: 12/804,964

(22) Filed: Aug. 3, 2010

(65) Prior Publication Data

US 2010/0301076 A1 Dec. 2, 2010

(51) Int. Cl.
*A43B 3/12* (2006.01)

(52) U.S. Cl.
USPC ..... 36/11.5; 36/15

(58) Field of Classification Search
USPC ..... 36/11.5, 15
See application file for complete search history.

(56) References Cited

U.S. PATENT DOCUMENTS 2,985,970 A * 5/1961 McCarthy ..... 36/11.5
3,693,269 A * 9/1972 Guarrera ..... 36/15
3,903,620 A * 9/1975 Gillet ..... 36/25 R
5,771,605 A * 6/1998 Safdie ..... 36/25 R
5,983,527 A * 11/1999 Strickland et al. ..... 36/12
6,640,465 B1 * 11/2003 Burgess ..... 36/15
7,377,054 B2 * 5/2008 Milner et al. ..... 36/15
2005/0011084 A1 * 1/2005 Stephenson ..... 36/15
2006/0037214 A1 * 2/2006 Goggin-Lewis ..... 36/11.5
2006/0112591 A1 * 6/2006 Lombardo ..... 36/7.5
2008/0098617 A1 * 5/2008 Garrett ..... 36/11.5
2010/0037485 A1 * 2/2010 Wu ..... 36/91

* cited by examiner

*Primary Examiner* — Marie Bays
(74) *Attorney, Agent, or Firm* — Ted M. Anthony

(57) ABSTRACT

This invention is a type of adhesive footwear for humans. The adhesive bond between the footwear and foot eliminates the need for shoestrings, Velcro, zippers, or any other type of fastening device. Unlike other types of footwear, the adhesive bond enables the footwear to remain in place and causes less discomfort when the foot becomes wet, sandy, or muddy. The footwear is precut into a shape that makes it capable of fitting several different sizes and types of feet. It is applied to the feet by stepping directly onto the adhesive side of the slip resistant material. Only the material needed will remain attached to the foot, making the footwear as light as possible.

7 Claims, 3 Drawing Sheets

ADHESIVE FOOTWEAR

CROSS REFERENCES TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF INVENTION

People are constantly coming up with new and inventive water activities. As a result, many people are frequently injured from the associated hazards; many of which, involve injuries to the feet. While the current water shoes may offer some protection against puncturing and slipping, they also create other annoyances when wet, sandy, and/or muddy. In most cases, current water shoes create more discomforts than they help eliminate. As a result, many patrons of water activities remove their footwear before getting wet.

Two of the most common types of footwear seen around pools and beaches are flip-flops and sandals. Both types of footwear must be removed before getting wet. Most flip-flops and sandals become so slippery if they get wet that it is difficult to walk or even stand, without falling.

BRIEF SUMMARY OF INVENTION

The proposed invention solves the problems associated with sand, mud, and water by creating an adhesive bond to the bottom of the foot in such a way that no other means of support are necessary to keep the footwear in place. The adhesion forms a barrier between the foot and footwear, keeping water, sand, and mud out. This type of bond eliminates chafing because the foot and footwear do not rub up against each other. This new type of footwear feels more natural because it does not inhibit the foot's natural abilities, but still protects the feet from becoming worn and blistered.

The invention capitalizes on this new method of adhering footwear in place by precutting the sheet of slip-resistant material into a shape that makes the footwear only bond to the parts of the foot that need protection. The precut shapes also make the footwear capable of fitting many different shoe sizes. It also minimizes the amount of weighted material bonded to the foot, and makes the footwear capable of being worn in sand, water, and mud without creating a nuisance.

DESCRIPTION OF VIEWS (FIG. 1) is an exploded perspective, bottom view of the footwear.

Figure 2:
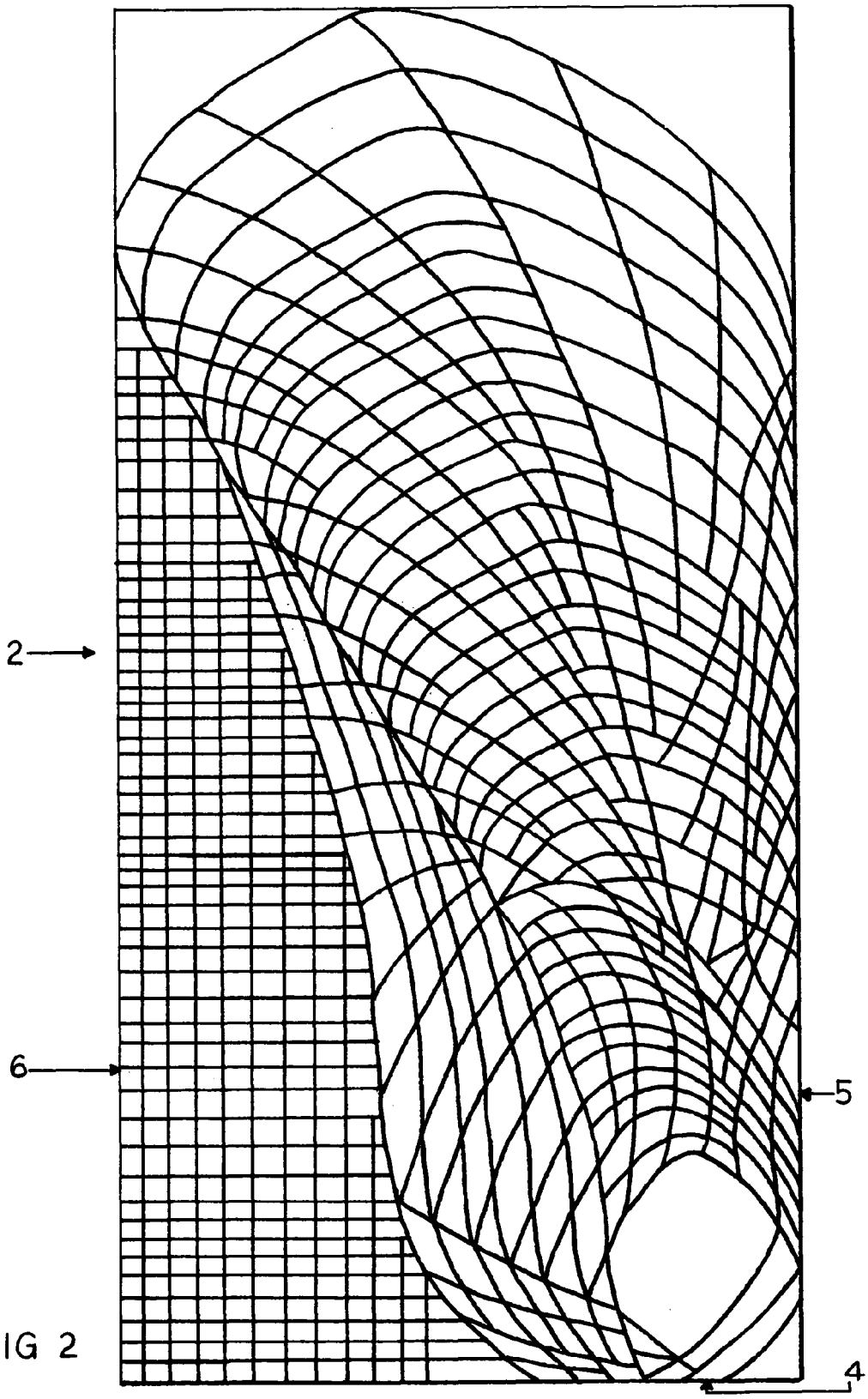

(FIG. 2) is a top view of (2).

Figure 3:
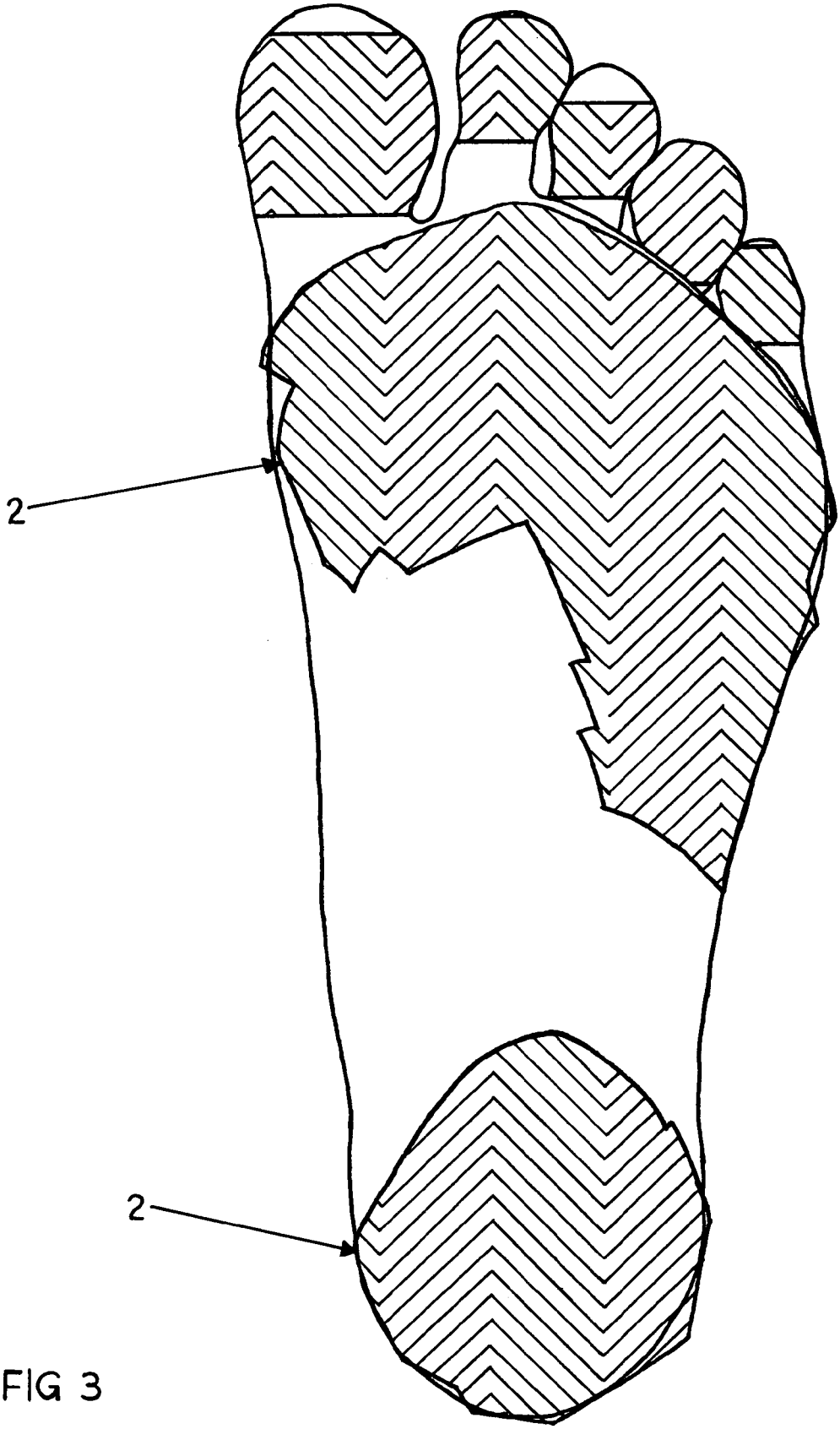

(FIG. 3) is a bottom view of (2) attached to a foot.

DETAILED DESCRIPTION OF THE INVENTION

Figure 1:
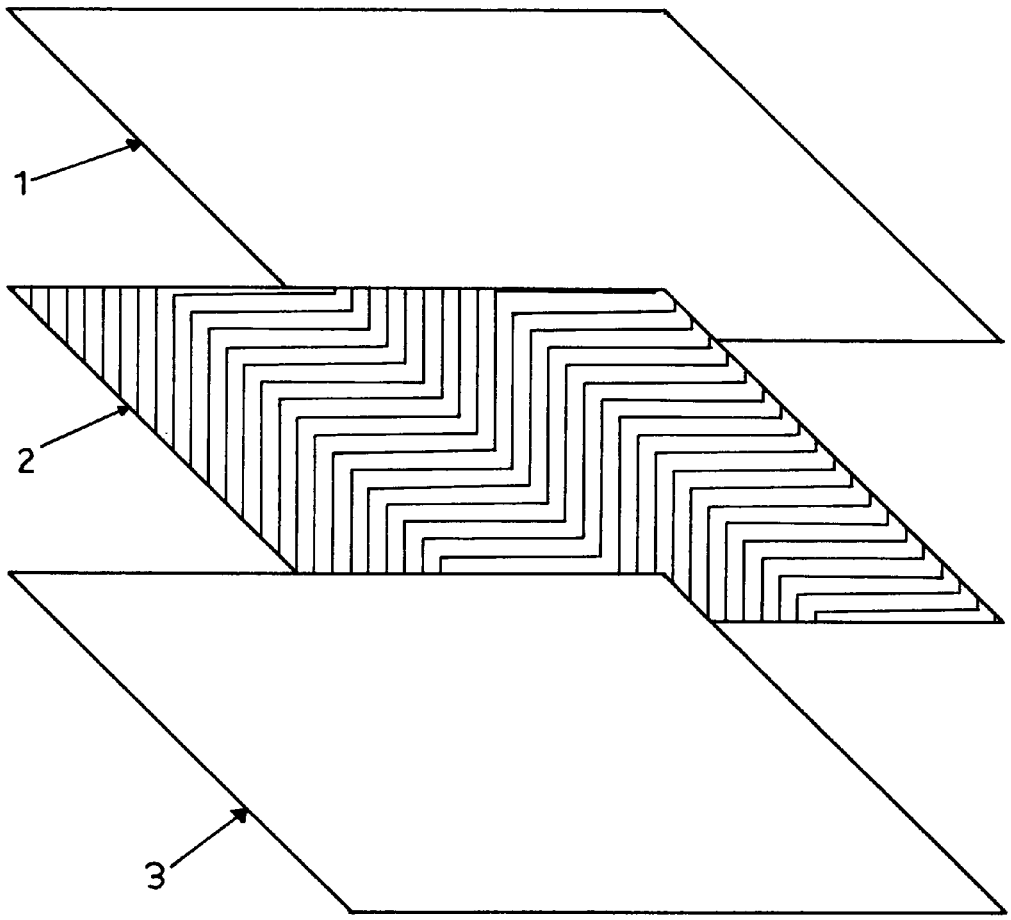

There are three distinct sheets of material (FIG. 1). The goal of sheet 1 is to protect the adhesive side of sheet 2. Sheet 2 is made of a slip resistant material with a slip resistant texture on one side and an adhesive coating on the other side. Sheet 2 is precut into a shape (FIG. 2) that enables the footwear to fit several different size feet. The tacky surface of sheet 3 keeps the unneeded pieces of sheet 2 from becoming attached to the foot. The bond between sheet 2 and 3 is weaker than the bond created between sheet 2 and skin.

The invention is first applied by cleaning the foot in which the user intends to apply the footwear. Once the foot is clean and dry, sheet 1 is removed from sheet 2. The user must then place their heel onto sheet 2 as close to the corner of lines 4 and 5 as possible, but without crossing over lines 4 and 5. Once the heel is in place, the user presses down on sheet 2 along line 5, but without crossing over line 5. The footwear can be applied to the toes by rolling each toe along the edge (6) of sheet 2. Now that the footwear has been applied, sheet 3 can be discarded along with the pieces of sheet 2 that remain attached to sheet 3.

To remove the footwear, the user simply pulls the pieces of sheet (2) off of their feet.

The invention claimed is:

1. A protective foot covering comprising:

a) a first release sheet;

b) a second release sheet;

b) a durable sheet material having a first side and a second side, said first side having an adhesive surface adapted to adhere to the sole of a foot and said second side having a slip-resistant surface, wherein said first side is removably disposed on said first release sheet and said second side is removably disposed on said second release sheet.

2. The protective foot covering of claim 1, wherein said durable material comprises a plurality of pre-cut sections.

3. The protective covering of claim 2, wherein said plurality of pre-cut sections forms a substantially cross-hatched pattern.

4. A method for applying a protective foot covering comprising:

a) providing a protective foot covering, said protective foot covering comprising:

i) a first release sheet;

ii) a second release sheet;

iii) a durable sheet material having a first side and a second side, said first side having an adhesive surface adapted to adhere to the sole of a foot and said second side having a slip-resistant surface, wherein said first side is removably disposed on said first release sheet and said second side is removably disposed on said second sheet;

b) removing said first release sheet from said durable material;

c) contacting a foot against said first side of said durable material;

d) adhering said durable material to said foot; and e) removing said second release sheet from said foot, wherein the adherence of said durable material to said foot is greater than the adherence of said durable material to said second release sheet.

5. The method of claim 4, wherein said durable material comprises a plurality of pre-cut sections.

6. The method of claim 5, wherein said plurality of pre-cut sections forms a substantially cross-hatched pattern.

7. The method of claim 6, wherein said durable material is disposed only on the portion of said foot that contacts said durable material.

* * * * *